US005207784A

United States Patent [19]

Schwartzendruber

[11] Patent Number: 5,207,784

[45] Date of Patent: May 4, 1993

[54] VENDING MACHINE WITH MONITORING SYSTEM

[76] Inventor: Wilbur Schwartzendruber, 53 3rd Road East, Stoney Creek, Ontario, Canada, L6G 3X4

[21] Appl. No.: 737,144

[22] Filed: Jul. 29, 1991

Related U.S. Application Data

[63] Continuation-in-part of Ser. No. 320,970, Mar. 9, 1989, abandoned.

[51] Int. Cl.[5] ..... G07F 11/00

[52] U.S. Cl. ..... 221/6; 221/14

[58] Field of Search ..... 221/6, 2, 14, 17, 3, 221/200; 198/455

[56] References Cited

U.S. PATENT DOCUMENTS

| | | | |
|---|---|---|---|
| 1,835,595 | 7/1928 | Friedrichs | 194/217 |
| 3,095,997 | 5/1961 | Garvin | 221/180 |
| 3,175,669 | 2/1963 | Garvin | 194/2 |
| 3,513,962 | 3/1968 | Stone et al. | 198/57 |
| 3,749,280 | 7/1973 | Gale | 221/67 |
| 4,398,651 | 8/1983 | Kumpfer | 221/6 |
| 4,629,090 | 12/1986 | Harris | 221/7 |
| 4,639,875 | 1/1987 | Abraham | 364/479 |
| 4,706,794 | 11/1987 | Awane | 194/217 |
| 4,876,532 | 10/1989 | Sauls | 221/3 |
| 5,097,981 | 3/1992 | Degaspeni et al. | 221/3 |

FOREIGN PATENT DOCUMENTS

| | | | |
|---|---|---|---|
| 2912510 | 10/1979 | Fed. Rep. of Germany . | |
| 1-175695 | 7/1989 | Japan . | |
| 8600003 | 1/1986 | Netherlands | 221/6 |

*Primary Examiner*—Robert P. Olszewski
*Assistant Examiner*—Kenneth Noland

[57] ABSTRACT

A large inventory vending machine with monitoring system comprises a plurality of compartments for storing articles to be dispensed, user activated dispensing apparatus connected to respective ones of the compartments for dispensing individual ones of the articles, circuitry for detecting the number of articles in respective ones of the compartments, and circuitry for communicating the number of articles in respective ones of the compartments to a remote location, whereby inventory status of the vending machine is maintained at the remote location, a blockage detector in the vending machine, a blockage release member moveable to release a blockage of articles, and a power system for operating the blockage release member when a blockage is detected.

19 Claims, 6 Drawing Sheets

VENDING MACHINE WITH MONITORING SYSTEM

This application is a continuation-in-part of application Ser. No. 320,970 and title Vending Machine With Monitoring System, inventor Wilbur Schwartzendruber, filed Mar. 9, 1989, now abandoned.

BACKGROUND OF THE INVENTION

Field of the Invention

The present invention relates in general to vending machines and more particularly to a vending machine incorporating circuitry for communicating inventory status to a remote location, and further incorporating blockage release means operable to release blockages of articles within the vending machine.

Background of the Invention

Vending machines are well known in the prior art for storing quantities of articles or merchandise to be dispensed. Such vending machines typically include user activated apparatus such as motors, for example for dispensing individual articles (e.g. cans of soft drink, food packages, tobacco products, and the like) upon payment of monies to the vending machine.

Prior art vending machines typically incorporate visual indication means such as lamps or lights for indicating depleted inventory in a specific selection of articles. Thus, a prospective purchaser is apprised of any empty stock prior to depositing monies into the machine.

Owners of such vending machines, herein referred to as vending companies, usually employ full-time service personnel to periodically visit respective locations of the vending machines to ascertain inventory status in the various merchandise compartments of the vending machines and to replenish depleted or dwindling merchandise supplies, if necessary. In practice, present day vending machines are periodically monitored and filled on a time scheduled basis since merchandise sales of the machines are not sufficiently documented to permit an accurate assessment of inventory.

Thus, vending machine companies are faced with an on-going cost for maintaining inventory check and replenishment schedules involving a great many manhours as well as depreciation and wear on the trucks or vehicles used by such personnel for travelling to various locations of the vending machines to ascertain inventory, etc. Moreover, service personnel often arrives at a vending machine location only to discover that the inventory is almost full and that he or she has wasted a trip to the site. Furthermore, in the event the inventory associated with a particular merchandise becomes depleted between successive visits of the service personnel, prospective customers are faced with the frustration of being unable to obtain the depleted merchandise.

In an effort to overcome the disadvantages associated with the above-discussed prior art, the system of the present invention comprises a plurality of user operated vending machines, each of the machines including circuitry for detecting and maintaining an accurate inventory count of articles stored within the machines. Each of the machines includes a communications circuit such as a modem, for communicating digital signals representative of respective inventories for different merchandise within the machines to a remove inventory control centre via respective telephone lines.

The self-monitoring vending machine of the present invention can be operated in one of two modes. According to the first mode, each of the machines can be interrogated by the remote inventory control centre via the telephone lines in order for a person at the inventory control centre to determine the exact inventory within the machine. Alternatively, according to a second mode of operation, the vending machines may be programmed to automatically communicate to the inventory control centre depletion or near depletion of any selection of merchandise within the machines. In this way, the inventory control centre is alerted to near depletion of inventory in advance, such that service personnel may be dispatched to the particular vending machine for replenishing the supply prior to depletion. In this regard, each of the vending machines according to the present invention incorporates circuitry for generating an identification signal for identifying to the inventory control centre which of the vending machines it is communicating with.

Thus, it is expected that the vending machine system of the present invention will result in considerable cost savings in terms of manpower and vehicle wear over prior art systems, and will result in less user dissatisfaction with vending machines which are frequently depleted of one or more selections of merchandise.

Another disadvantage associated with a certain design of prior art vending machines was the problem of blockage or jamming of articles stored in bulk within the storage and dispensing portions of the machine. U.S. Pat. Nos. 3,095,997 and 3,175,669 (Garvin) disclose a bulk storage vending machine which utilizes baffles to support and distribute the weight of articles within an article storage hopper so as to provide spaces within the hopper. A shaker plate was incorporated which was operable to cause movement of at least some of the articles to break up natural bridges formed therein. The shaker plate operated each time the coin slide was operated, whether a blockage was present, or not.

The effect of rotating motion provided by the baffle was affected by the size of the cavity as well as the size and weight of the object. In other words, the baffle arrangement may be useful for lightweight cylindrical objects of a particular size (such as cylindrical containers containing soap powder), but will not typically work for heavier objects such as soft drink cans, and objects having variable dimensions. Thus all of the articles stored within the vending machine of Garvin were required to be of the same dimensions or sizes.

According to a further aspect of the present invention, a blockage release member in the form of a vertical V-belt drive, is disposed within each column of a large capacity hopper or storage compartment of a vending machine, for contacting articles and merchandise stored in the respective compartment. The V-belt drive is activated by a motor for rotating the belt such that the surface of the belt in contact with the merchandise articles moves upwardly within the compartment. Upward movement of the vertically oriented V-belt has been found to cause shifting and re-distribution of articles within the compartment so as to prevent jamming or bridging of the articles therewithin. The motor is also operable in the reverse direction to cause downward movement of the belt, which will be operative to release blockages, which cannot be released by the upward movement of the belt.

Furthermore, the V-belt anti-bridging system of the present invention works equally well for articles of varying sizes of cylindrical objects.

U.S. Pat. No. 1,835,595 (Friedrichs) discloses a horizontal belt drive for dispensing cigarettes. The belt is used strictly as a dispensing mechanism and not as a means to break the bridging effect of stored articles. Specifically, Friedrichs does not address the problem of bridging since cigarettes are light weight in relation to volume such that bridging is not typically a problem. Furthermore, the belt drive of Friedrichs specifically teaches rotation in a direction such that the surface contacting the cigarettes moves horizontally relative to the storage container in order to dispense the cigarettes therefrom. Vertical orientation of the V-belt drive and upward rotation thereof for the purpose of eliminating bridging of heavy articles within the container, is nowhere contemplated or suggested in the Friedrichs patent.

SUMMARY OF THE INVENTION

In general, according to an aspect of the present invention, there is provided vending apparatus with self-monitoring system, comprising at least one compartment for storing a predetermined quantity of articles to be dispensed, user activated means for dispensing individual ones of said articles from said compartment, means for counting said individual ones of said articles dispensed by said user activated means and in response maintaining a predetermined count value representative thereof, means for subtracting said predetermined count value from said predetermined quantity and in response generating a signal representative of the number of said articles remaining in said compartment, means for transmitting said signal to a remote location, whereby inventory status of said vending machine is communicated to said remote location, feed path means for transmitting articles from said compartment, to a delivery point, sensing means for sensing the presence or absence of articles at a predetermined location in said feed path, absence of said articles therefrom indicating a blockage of said articles in said compartment, blockage release means movably operable for releasing said blockage, said blockage release means being connected to said article sensing means, and being operable in response to an article absent signal therefrom, whereby to release said blockage of said articles in said compartment.

According to another aspect of the present invention, there is provided vending apparatus with self-monitoring system, comprising a plurality of compartments for storing articles to be dispensed, user activated means connected to respective ones of said compartments for dispensing individual ones of said articles, means for detecting the number of said articles in respective ones of said compartments, and means for communicating said number of said articles to a remove location.

According to yet another aspect of the present invention, there is provided a vending machine system comprising a plurality of user operated vending machines, each of said machines including means for detecting and maintaining an accurate inventory count of articles stored within said machines, an inventory control centre for connection to respective ones of said machines via respective telephone lines, and a plurality of communication means connected to respective ones of said vending machines for generating and transmitting respective status signals to said inventory control centre via said telephone lines, said status signals representing said inventory count of articles stored within respective ones of said machines.

According to a further aspect of the present invention, there is provided a vending machine, comprising, at least one large capacity compartment for storing a predetermined quantity of articles to be dispensed, user activated means for dispensing individual ones of said articles from said compartment, a movable blockage-release member mounted within said compartment and having a surface in contact with said articles, and drive means for causing reciprocable movement of said surface to and fro, such that said articles in contact with said surface shift and reposition relative to one another, thereby alleviating bridging of said articles within said compartment.

The various features of novelty which characterize the invention are pointed out with more particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

IN THE DRAWINGS

DETAILED DESCRIPTION OF A PREFERRED EMBODIMENT

Figure 1:
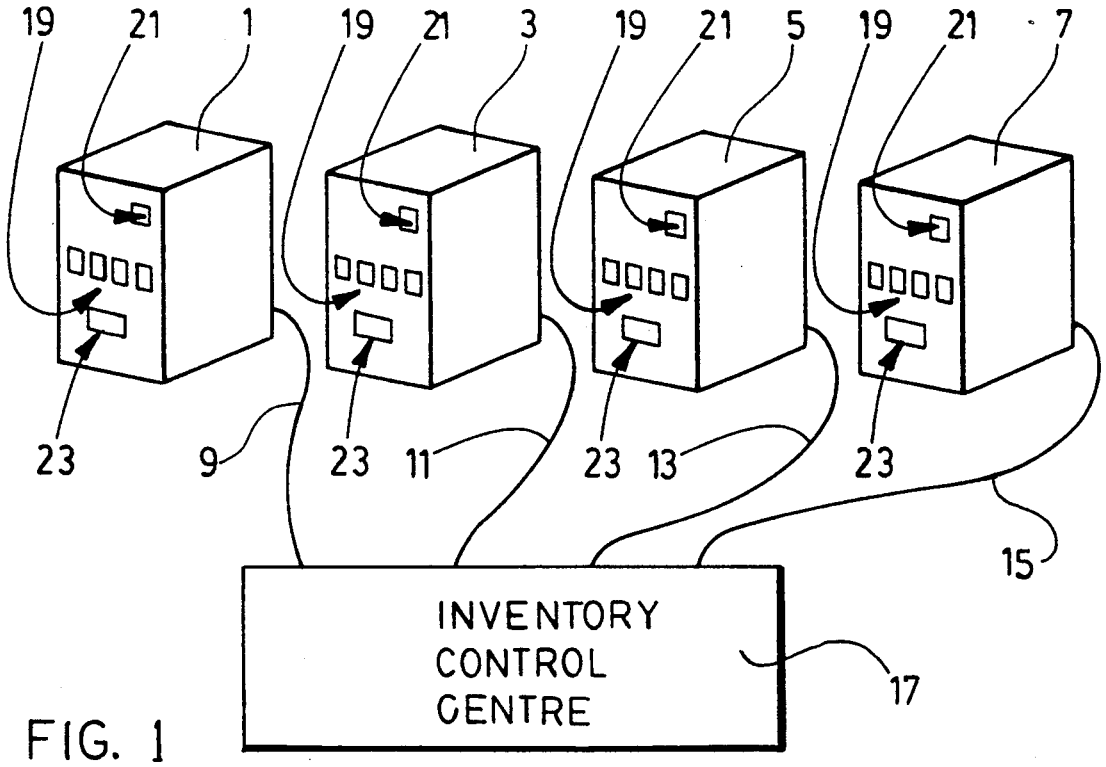
FIG. 1 is a schematic block diagram showing the vending machine system of the present invention according to a general aspect.

Turning to FIG. 1, the vending machine system according to the present invention is shown comprising a plurality of vending machines 1, 3, 5 . . . 7 connected via respective telephone lines 9, 11, 13 . . . 15 to an inventory control centre 17.

Each of the vending machines 1–7 comprises a plurality of selection switches 19 by which a customer enters merchandise selection after inserting coinage into a coin slot 21. In response, the associated one of vending machines 1–7 dispenses an individual article of merchandise at a delivery port 23 thereof.

The articles of merchandise which are dispensed from the vending machines 1–7 can be, for instance, cans of soft drink or pop, or cylindrical packaging containing, for example, candy or chocolate bars, potato chips, sandwiches, and the like.

According to the present invention, as described in greater detail below with reference to FIG. 3, each of the vending machines 1–7 include circuitry for detecting and maintaining an accurate inventory count or articles stored within respective compartments of the vending machines. Each vending machine also incorporates a communication circuit such as a modem connected to respective ones of telephone lines 9–15 for communicating respective status signals indicative of the inventory count of articles stored within respective ones of the machines to the inventory control centre 17.

Thus, in the event that the inventory of a particular article of merchandise within one of the vending machines (e.g. machine 3) is close to depletion, the circuitry within the machine 3 may be programmed to initiate a telephone call via line 11 to the inventory control centre for communicating inventory information to the control centre 17. A central operator or operators at the inventory control centre 17 may thus be apprised of the depleting inventory in machine 3, and may then dispatch service personnel for replenishing the supply within machine 3 prior to depletion.

In this regard, each of the vending machines 1–7 also comprises circuitry for generating an identification signal representative of the particular vending machine, in order that personnel or apparatus at the inventory control centre 17 may distinguish between respective ones of the machines.

Alternatively, as described in greater detail with reference to FIG. 3, an operator or operators at the inventory control centre 17 may individually interrogate or poll specific ones of the vending machines 1–7 via telephone lines 9–15, respectively, in order to periodically ascertain inventory levels of merchandise stored therewithin.

Figure 2:
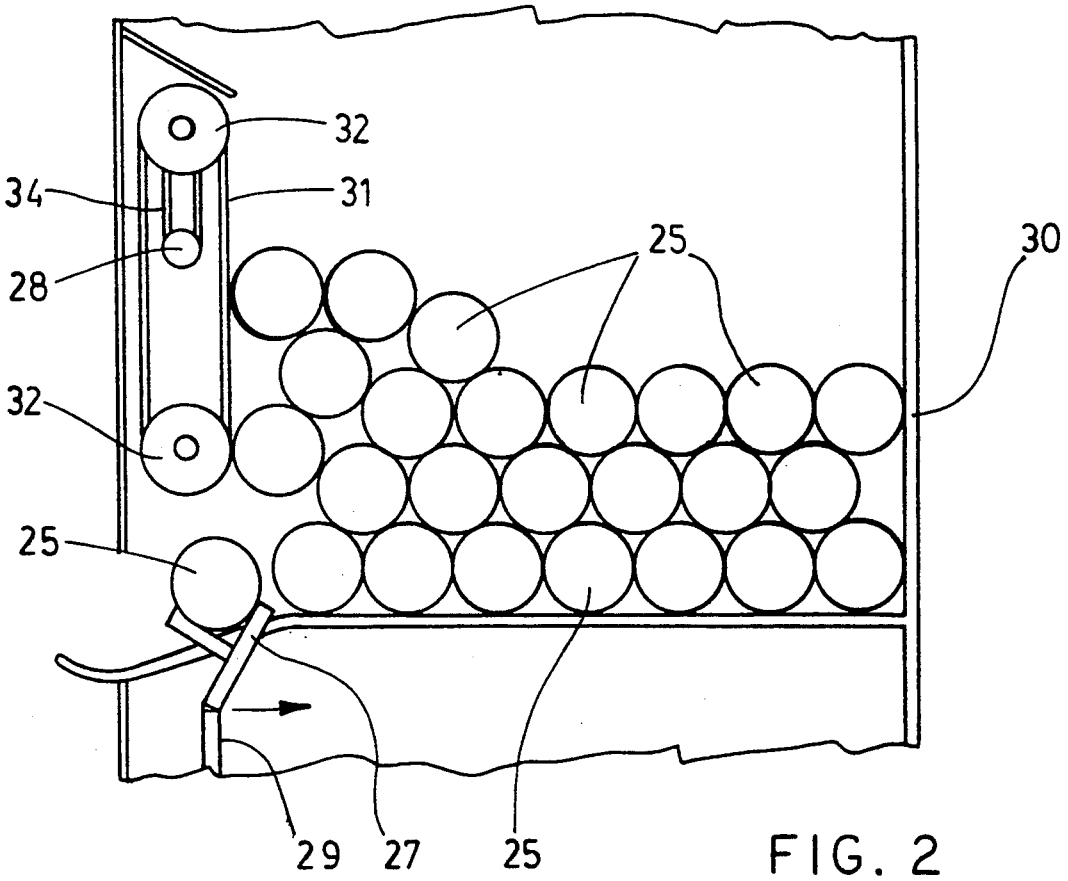
FIG. 2 is a cross-sectional view of an internal portion of a vending machine in accordance with a preferred embodiment of the present invention.

Turning to FIG. 2, a compartment 30 of a plurality of compartments comprising large inventory vending machine is shown in accordance with a preferred embodiment of the present invention. Soft drink cans 25 are stored from left to right in FIG. 2 along the depth of the compartment for housing numerous rows of articles, in this case cans, in each of the separate compartments, of the entire machine.

Dispensing mechanism 27 is shown for releasing individual articles, in this case soft drink cans in response to user activation of a selection switch (not shown). Such dispensing apparatus is well known in the art, as exemplified by dispensing rocker assembly apparatus disclosed in U.S. Pat. No. 3,175,669 (Garvin). An electrically isolated sensor 29 optically detects movement of the dispensing mechanism 27 for detecting dispensing of individual ones of the soft drink cans 25 from the compartment. The sensor 29 can, for instance, be mounted across the motor windings of an electric motor (not shown) for operating the dispensing mechanism 27. Any other convenient and well known mounting of optical sensor 29 may be employed.

A motor 28 drives a belt drive 31 which runs around pullies 32, to act as a blockage release system. Motor 28 is connected to pullies 32 by means of drive belt 34.

The motor 28 or other driving apparatus in this case is also responsive to user activation of one of the selection switches 19. By activating the belt drive 31, moving the surface of drive 31 which is in contact with the cans 25 which rotate in relation to the compartment 30 such that the soft drink cans in contact therewith roll and shift into cooperative positioning relative to adjacent cans, thereby alleviating bridging of the cans within the compartment. As discussed herein above, this bridging phenomenon is a well known disadvantage of prior art vending machines.

Figure 3:
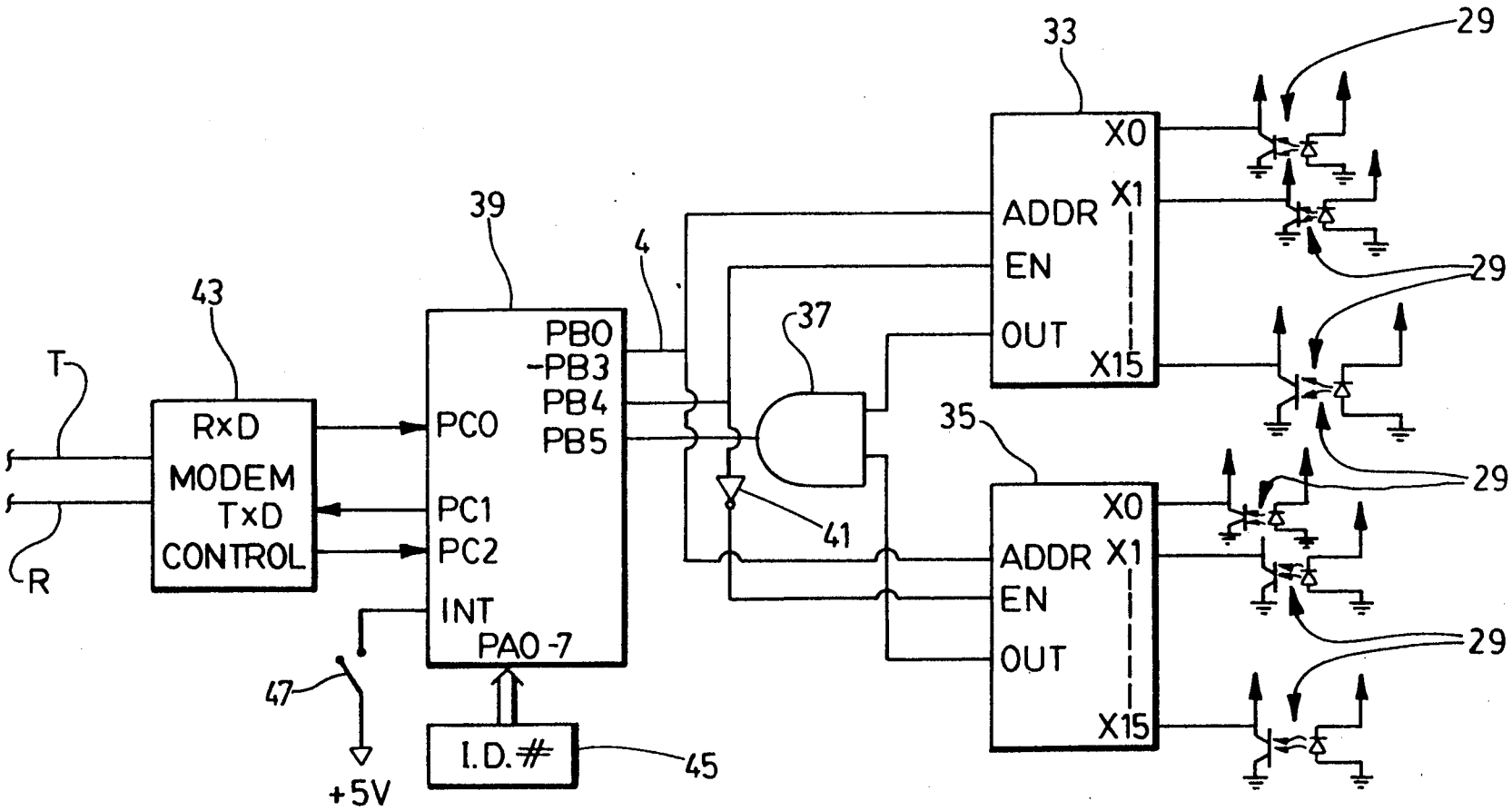
FIG. 3 is a microprocessor and communication circuitry according to the preferred embodiment.

Turning to FIG. 3, in accordance with the preferred embodiment for monitoring the inventory status of respective compartments of respective vending machines 1–7, a pair of digital multiplexers 33 and 35 are shown having sixteen input lines X0–X15 each connected to a corresponding one of the optical sensors 29 (FIG. 2) and a single complementary output line OUT connected via an AND gate 37 to an input port PB5 of microprocessor 39.

Output ports PB0–PB3 of microprocessor 39 provide a four-bit address signal to corresponding address inputs ADDR of multiplexers 33 and 35 for selecting a predetermined one of the sixteen input lines X0–X15 in each of the multiplexers 33 and 35. An additional output port line PB4 is connected directly to an enable input of multiplexers 33 and via an inverting circuit 41 to the enable input EN of multiplexer 35.

In operation, microprocessor 39 executes software for serially polling respective inputs of multiplexers 33 and 35 by virtue of generating predetermined address and enable signals on ports PB0–PB3 and PB4.

For example, in response to generation of an address value of 0001 on the PB0–PB3 outputs of microprocessor 39 in conjunction with a logic low level signal on the PB4 output, multiplexer 35 is enabled and the second input line X1 is selected for application to AND gate 37. The multiplexer 33 is disabled such that the data output OUT thereof generates a logic high signal.

Accordingly, AND gate 37 generates a signal which is equal to the logic level appearing on the selected input line X1 of multiplexer 5, for application to the PB5 input port of microprocessor 39.

Within microprocessor 39, an internal RAM memory location is associated with the selected input line X1 of multiplexer 35 for storing a count value indicative of the number of articles which have been dispensed from the compartment of the vending machine associated with input line X1 of multiplexer 35. The count value is incremented in the event that the input line is at a logic high level (i.e. one article from the associated compartment has been dispensed) or else is maintained at the current value in the event that the input line X1 is at a logic low level (i.e. indicating that no article is being dispensed).

Thus, internal RAM memory of microprocessor 39 contains thirty-two predefined memory locations for storing count values associated with respective ones of the inputs X0–X15 for the two sixteen-bit multiplexers 33 and 35.

In this way, microprocessor 39 monitors the count value and subtracts this value from the known quantity of articles originally loaded into the compartment for arriving at an accurate inventory count of articles in the compartment. In the event that the inventory in one or more of the compartments reaches a critically low software definable level, the microprocessor 39 formulates and transmits a serial message for transmission to the inventory control centre 17 via modem 43 and tip and ring lines T and R of the associated one of telephone lines 9–15 (FIG. 1).

Circuitry 45 is provided for establishing a digital identification number associated with individual ones of the vending machines. According to the preferred embodiment, circuitry 45 was in the form of eight microswitches, each connectable between a source of logic low and logic high voltage for creating an eight-bit digital identification number signal. The identification number signal from circuitry 45 is applied to input ports PA0–PA7 of microprocessor 39. The identification number signal is output as part of the serial message transmitted via modem 43 to inventory control centre 17, thereby allowing inventory control centre 17 to distinguish between various ones of the vending machines 1–7.

The serial message signal is output from microprocessor 39 via the PC1 port for connection to a TxD serial input of modem 43. Modem 43 operates in a well known manner to convert the serial message into a modulated digital carrier signal for transmission via the tip and ring leads T and R of the associated one of telephone lines 9–15 along with appropriate handshaking communication signalling via the control output of modem 43 connected to the PC2 input of microprocess.

The handshaking communication protocol established between microprocessor 39 and modem 43 is well known. Alternatively, as discussed above, inventory control centre 17 may interrogate each of the vending machines 1–7 by means of generating an appropriate interrogation message signal via the telephone lines for reception by the associated modem 43. The modem 43 demodulates the message signal carried by the telephone line and transmits the demodulated serial message signal via a RxD serial output port to the PCO input of microprocessor 39. A reset switch 47 is connected to external interrupt input INT of the microprocessor 39 for resetting or bootstrapping the microprocessor 39 at start-up. The reset or bootstrap routine clears all registers and memory location within microprocessor 39, in a well known manner.

Thus, according to the present invention, each of the vending machines 1–7 actually notifies the inventory control centre 17 in the event that one or more of the vending machine merchandise compartments require replenishment of inventory. This feature effectively saves the vending machine company or soft drink supplies from having to undertake periodic unnecessary trips to remote vending machine sites in order to ascertain the state of inventory and replenish if necessary.

Other embodiments and variations of the present invention are contemplated. For example, one or more of the optical sensors 29 may be replaced by motion detectors or other alarm switches or circuits, and the software may be modified accordingly to generate and transmit an alarm message to the central inventory control centre 17 in the event of unauthorized tampering with the associated vending machine. Furthermore, the alarm switches or circuits may be connected to doors or windows remote from the vending machine itself, for implementing a standard burglar alarm system for the vending machine location premises. Also, although the preferred embodiment of the vending machine utilizes a modem in conjunction with telephone lines connected to the inventory control centre, it is contemplated that other communication links such as radio or cellular telephone may be used. In particular, an alternative embodiment of the invention utilizing a cellular telephone allows the inventory control centre 17 to be in the form of a mobile service vehicle.

All these and other embodiments are believed to be within the sphere and scope of the present invention.

In accordance with a further embodiment of the invention an improved form of anti-blockage system may be provided, as illustrated in FIGS. 4 through 9.

Figure 4:
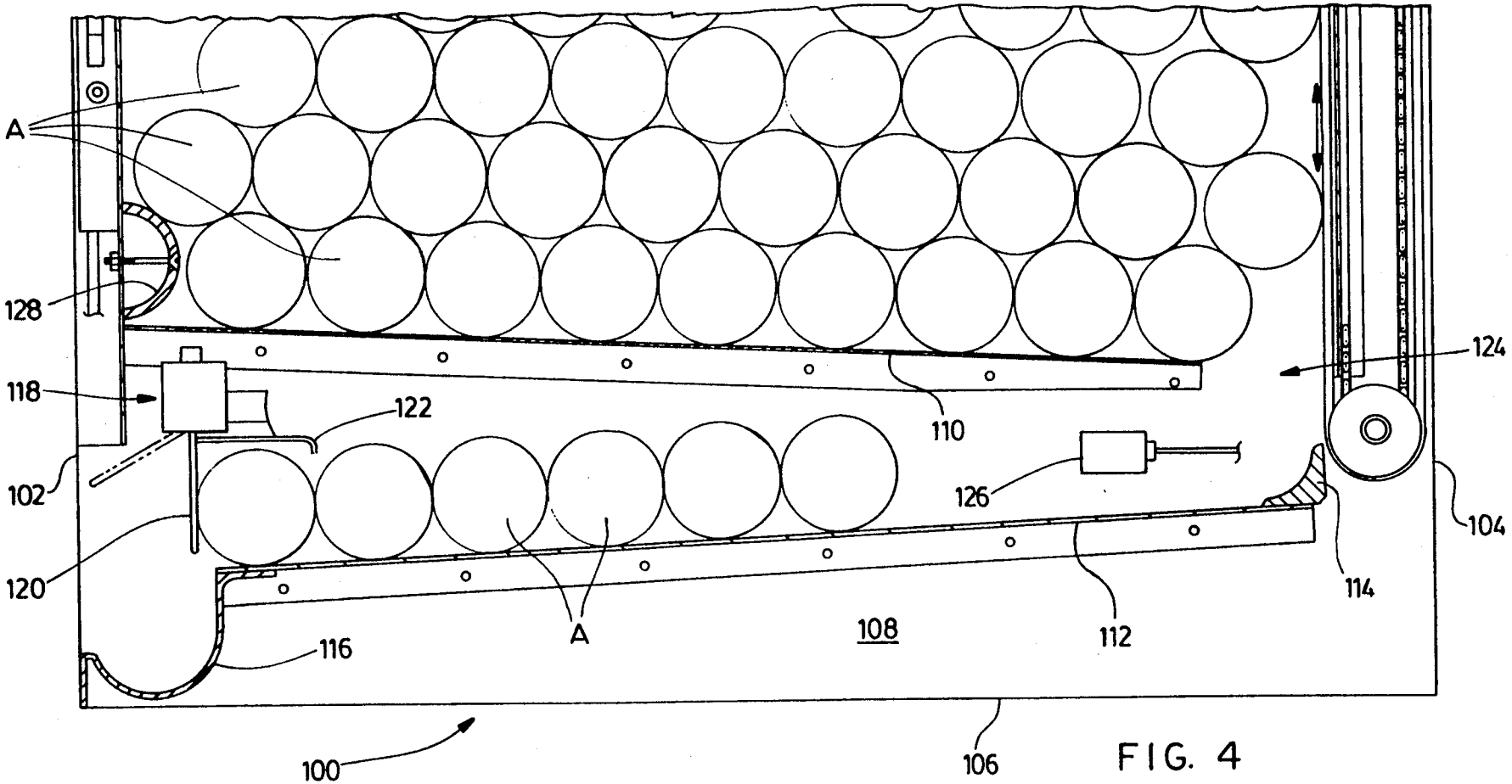
FIG. 4 is an enlarged cross-sectional view of a lower portion of the vending machine in accordance with an alternate embodiment.

As illustrated in FIG. 4, the lower portion of a vending machine is illustrated generally as 100. It will be seen to comprise a front wall 102 and a rear wall 104 and a bottom wall 106. There may be a single so-called "column" or a plurality of so-called "columns" of articles within a given vending machine. Thus sidewall 108 may represent a side wall of the vending machine, or an intermediate partition panel. It will be of course appreciated that since this view is a section, there will be another such sidewall or partition wall, which is omitted from this drawing (see FIG. 5).

Between the two sidewalls of partition walls 108—108, there are supported, a first upper sloping feed wall 110 and a second reversed sloping delivery wall 112.

Wall 110 slopes downwardly from the front wall 102 towards the back wall 104. The second wall 112 slopes downwardly from adjacent the backwall 104 towards the front wall 102.

A curved guide member 114 is located at the upper end of wall 112. A lower delivery trough 116, is located at the forward lower end of wall 112.

In order to release articles indicated generally as A, one at a time, as they are vended, an article indexing mechanism indicated generally as 118 is provided. The indexing mechanism 118 which is preferrably electrically controlled by, and is connected to a coin release mechanism of a type well known in the art (not shown) incorporates a stop arm 120 which is swingably movable as shown in phantom, so as to allow the dispensing of a single article A.

An article check arm 122 is swingably connected to the arm 120, and is adapted to swing down as the arm 120 swings upwardly, thereby effectively blocking the dispensing of a second article.

The mechanism 118 is self-actuating, and once the endmost article A has been dispensed into the trough 116, the arm 120 will swing backwardly thereby trapping the next article A, and at the same time the arm 122 will swing upwardly once more.

Wall 112 is designed to support a plurality of articles along a shallow downwardly angled path. Articles are intended to be simply stacked in bulk and are fed from the upper portion of the vending machine, by gravity, and will move downwardly along wall 110, until they reach the rearward gap 124. At this point an article A will then fall downwardly and strike the guide 114, and will then roll down the wall 112.

In the event that blockage of articles A occurs so that they cannot feed downwardly through the gap 124, then eventually there will be an absence of articles A adjacent the upper end of wall 112.

In order to detect this, a sensor 126 is provided at this point. Typically sensor 126 is a photoelectric device. It will be understood that various other such devices are known which sense the presence or absence of an article such as article A, and the invention is not restricted to photoelectric devices.

In any event, in the absence of an article A alongside the sensor 126, the sensor 126 is adapted to send a "article absent" signal.

In order to assist in controlling the positioning and dispensing of articles within the dispenser, a semi-cylindrical baffle 128 is provided adjacent the front wall 102, and this causes the articles to adopt a generally zig-zag cross stacking effect, as shown in FIG. 4, when loaded in bulk.

Figure 5:
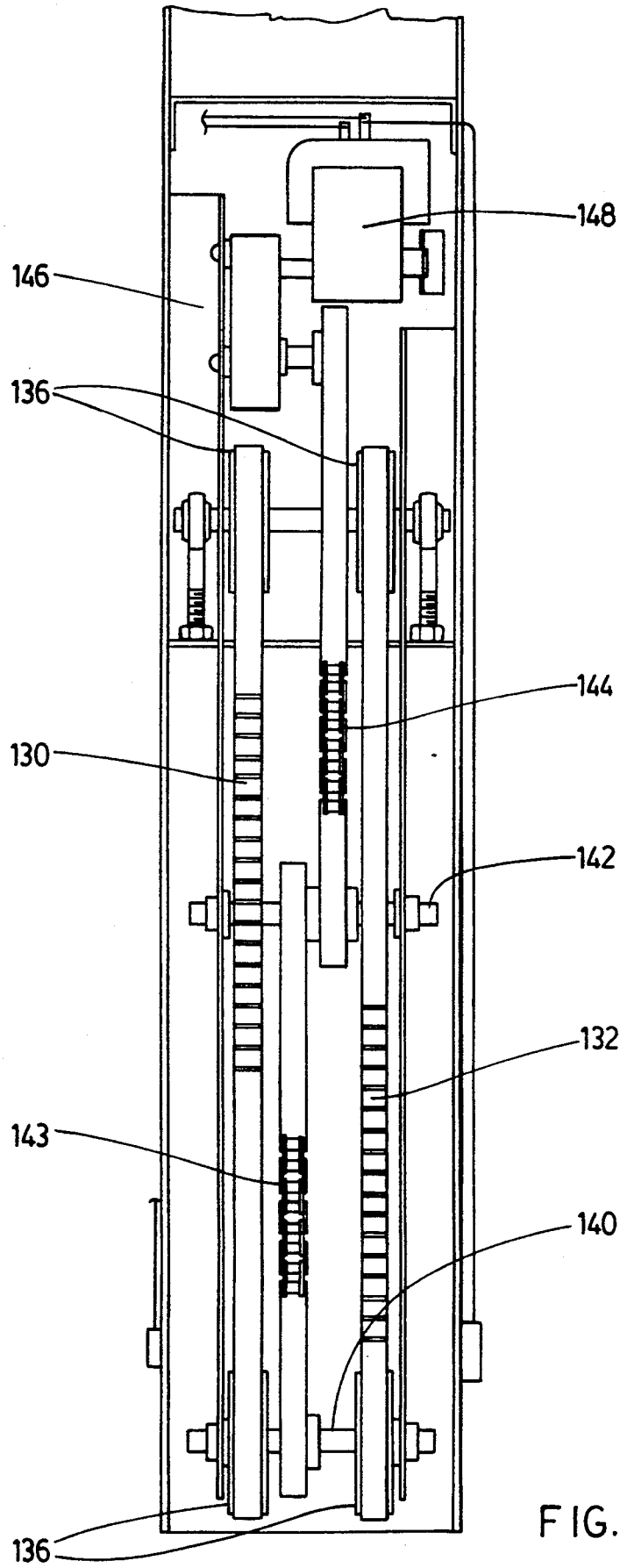
FIG. 5 is a rear vertical-section of the vending machine of FIG. 4 along the line 5—5.
Figure 6:
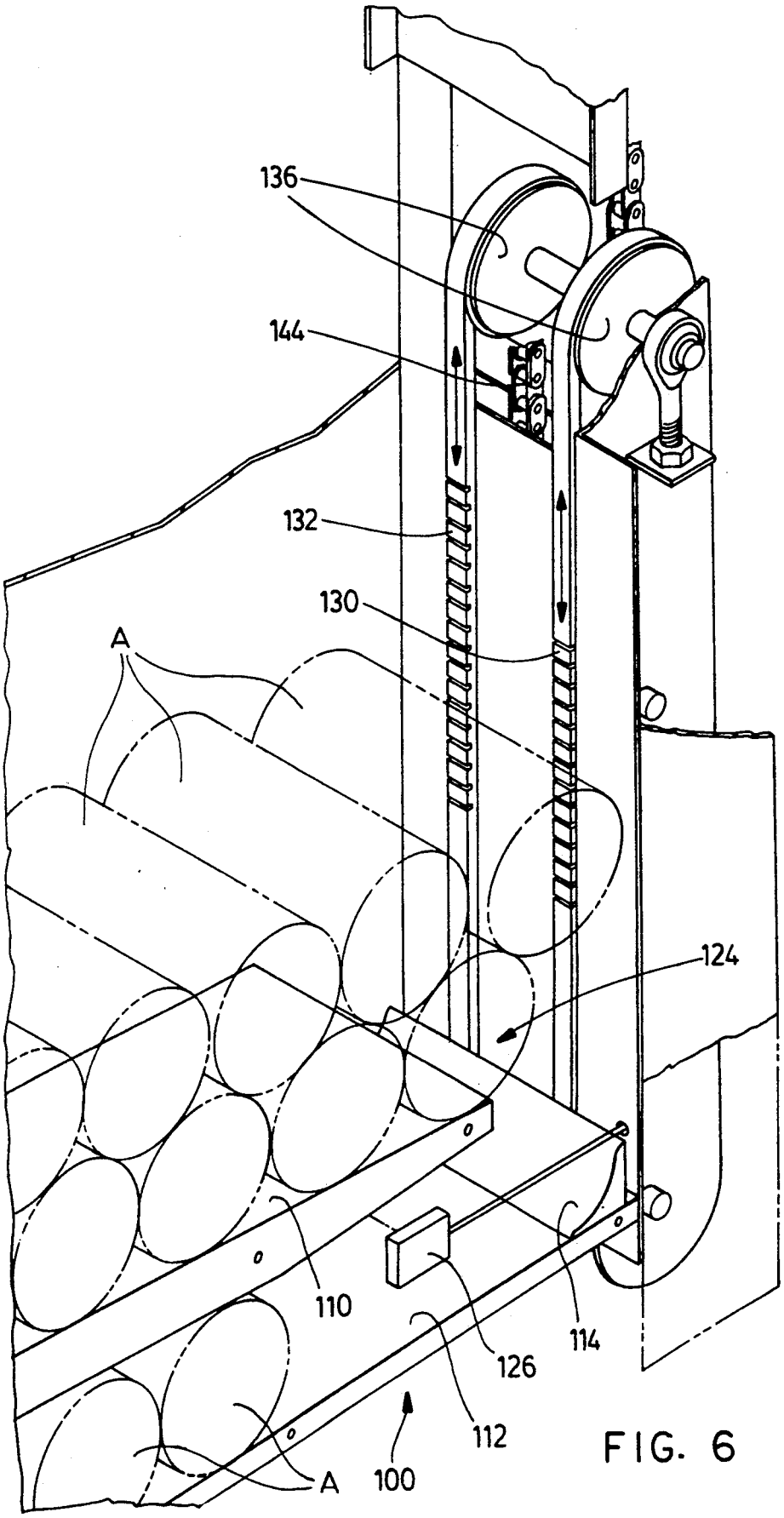
FIG. 6 is a perspective illustration showing the rear portion of the vending machine of FIGS. 4 and 5, and showing articles therein in phantom.

Referring now to FIGS. 4 and 5, it will be observed that the anti-bridging mechanism in accordance with the invention comprises, in this embodiment, a pair of movable anti-bridging members 130 132, which in this embodiment again comprise endless belts running around pullies 136 136.

A common drive shaft 140 extends between pullies 13. Drive shaft 140 is connected to an intermediate lay shaft 142 by chain 143. Shaft 142 is in turn driven by means of a chain 144 and motor 146.

Motor 146 is controlled by controller 148. Controller 148 is in turn connected to the sensing device 126.

The "article absent" signal from the sensing device will activate the controller. The controller is such that it will activate the motor first in one direction, and then in the reverse direction. This will then procure movement of the belts 132 and 134 upwardly and then downwardly.

Figure 7:
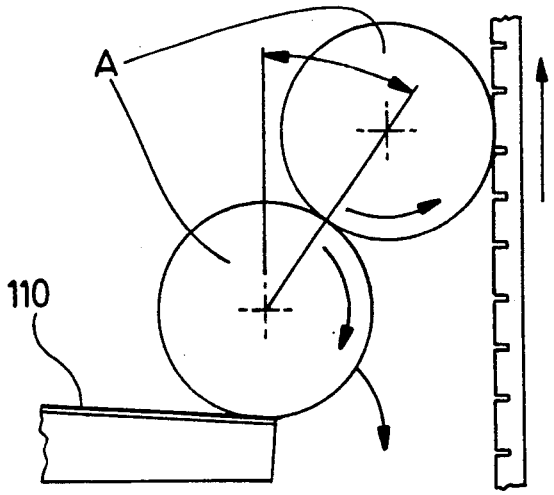
FIG. 7 is a side-elevational schematic illustration showing one form of bridge breaking action.
Figure 8:
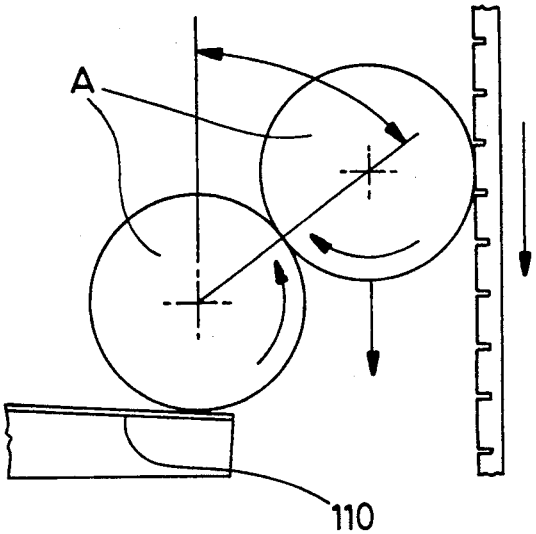
FIG. 8 is an illustration corresponding to FIG. 7 showing another form of bridge breaking action, and, FIG. 9 is an illustration corresponding to FIGS. 7 and 8 showing a further form of bridge breaking action.
Figure 9:
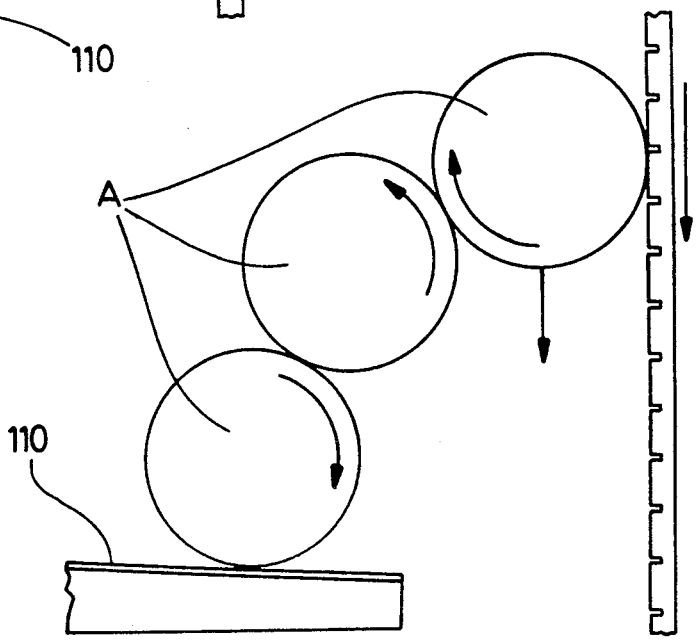

The effect of this movement will then be to procure the action as shown either in FIGS. 7, 8 or 9. In the simple bridging case of FIG. 7, upward movement of the belt will cause rotation of one of the articles A thereby permitting the other of the articles A to drop downwardly through the gap 124. In the case of reverse movement of the belt, as illustrated in FIG. 8, where the two bridged articles are in a somewhat different relation to one another, then it will cause rotation of the articles in the opposite direction and again release one of the articles to drop downwardly through the gap 124.

In the case of the third type of bridging namely where there are three such articles A, then the upward and downward movement will eventually release the upper most article as illustrated in FIG. 9.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. Vending apparatus with self-monitoring system, comprising:

at least one compartment for storing a predetermined quantity of articles to be dispensed;

user activated means for dispensing individual ones of said articles from said compartment;

means for counting said individual ones of said articles dispensed by said user activated means and in response maintaining a predetermined count value representative thereof;

means for subtracting said predetermined count value from said predetermined quantity and in response generating a signal representative of the number of said articles remaining in said compartment; and means for transmitting said signal to a remote location, whereby inventory status of said vending apparatus is communicated to said remote location.

2. Vending apparatus as defined in claim 1, further comprising means for initiating automatic transmission of said signal to said remote location in the event said number of articles remaining falls below a further predetermined value.

3. Vending apparatus as defined in claim 2, further comprising means for receiving an interrogation signal from said remote location and in response initiating transmission of said signal to said remote location.

4. Vending apparatus as defined in claim 1, wherein said means for transmitting said signal further comprises a modem for transmitting said signal to said remote location via a telephone line.

5. Vending apparatus as defined in claim 1, wherein said means for counting and said means for subtracting are further comprised of a microprocessor for executing a predetermined program.

6. Vending apparatus with self-monitoring system as claimed in claim 1, including a plurality of compartments for storing articles to be dispensed;

user activated means connected to respective ones of said compartments, for dispensing individual ones of said articles;

means for counting individual ones of said articles dispensed from respective ones of said compartments, and in response generating a signal representative of the number of said articles remaining in respective said compartments.

7. Vending apparatus as defined in claim 1, wherein said means for detecting comprises a microprocessor for counting said dispensing of individual ones of said articles, and in response generating respective count values for each of said plurality of compartments, subtracting said respective count values from respective predetermined total values representing initial inventories of said articles in respective ones of said compartments and in response generating respective digital signals representative of said number of said articles dispensed from respective ones of said compartments.

8. Vending apparatus as defined in claim 7, wherein said means for communicating comprises a modem for receiving and transmitting said respective digital signals via one or more telephone circuits to said remote location.

9. Vending apparatus as defined in claim 1, further comprising means for generating and transmitting an identification data signal for identifying said vending apparatus to said remote location via said means for communicating.

10. Vending apparatus as defined in claim 1, further comprising one or more alarm sensors for detecting unauthorized tampering with said vending apparatus and in response generating an alarm signal for transmission to said remote location via said means for communicating.

11. Vending apparatus as defined in claim 1, further comprising: a plurality of optically isolated sensors adapted for detecting said dispensing of said individual ones of said articles and in response generating respective status signals; multiplexer means for polling successive ones of said sensors for detecting one of either presence or absence of said respective status signals;

microprocessor means for maintaining respective count values corresponding to the quantity of said articles dispensed from respective ones of said compartments and incrementing said respective count values in response to detection of presence of said respective status signals; and modem means for transmitting said number of said articles in respective ones of said compartments in the event at least one of said count values exceeds a predetermined threshold value.

12. Vending apparatus as defined in claim 1, further comprising a "V" belt drive mounted within said at least one compartment, for shifting some said articles stored within said compartment, thereby releasing bridging of said articles within said compartment.

13. Vending apparatus with self-monitoring system, comprising:

at least one compartment for storing a predetermined quantity of articles to be dispensed in unrestricted vertical orientation, and defining a predetermined width, and depth, wherein a group of articles may be stacked within said component in side by side relation down to a lower end thereof;

user activated means operable intermittently for dispensing individual ones of said articles from said group downwardly from said compartment through a dispensing opening;

means for counting said individual ones of said articles dispensed by said user activated means and in response maintaining a predetermined count value representative thereof;

means for subtracting said predetermined count value from said predetermined quantity and in response generating a signal representative of the number of said articles remaining in said compartment;

means for transmitting said signal to a remote location; whereby inventory status of said vending apparatus is communicated to said remote location;

normally stationary breaking means movably supported in each said compartment and contacting at least one said article, on one side of said group of articles, and, means for intermittently moving and bridge breaking means in an upward and downward reciprocal movement whereby to procure release movement of said at least one said article in contact therewith, to break bridging of said articles within said compartment said belt means remaining stationary between operation thereof.

14. Vending apparatus with self-monitoring system, comprising:

at least one compartment for storing articles to be dispensed;

user activated means connected to said compartment, and operable intermittently for dispensing individual ones of said articles;

means for detecting the number of said articles in said at least one compartment;

means for communicating said number of said articles to a remote location;

jam sensing means for sensing jamming of said articles and delivering a jam signal;

normally stationary jam releasing means movably supported in said at least one compartment and contacting at least one said article, and, means for intermittently operating said jam releasing means in response to said jam signal to procure movement of said at least one said article in contact therewith, to break jamming of said articles within said compartment said jam breaking means remaining stationary between operation thereof.

15. Vending apparatus as claimed in claim 14, and including a support wall at a lower end of said vending machine, said support wall being angled at a downwardly sloping angle from the front towards the back of said vending machine, a feed opening defined at the downward end of said support.

16. Vending apparatus as claimed in claim 15 and including delivery wall means located below said support wall means, and angled from the rear of said vending machine toward the front, said delivery wall means defining an upper end located beneath said feed gap, whereby to receive articles passing therethrough, said articles then rolling down said delivery wall towards the front of said vending machine.

17. Vending apparatus as claimed in claim 16 and including sensing means located alongside said delivery wall, between said feed gap, and the forward portion of said vending machine, said sensing apparatus being adapted to sense the presence or absence of an article adjacent thereto, said being adapted to deliver a "article absent" signal.

18. Vending apparatus claimed in claim 17 and further including a power operated means for operating said bridge breaking means, said power operating means being adapted to be operated in response to delivery of a "article absent" signal by said sensing means, said bridge breaking means thereafter performing a reciprocable motion to and fro along a predetermined path, whereby to break up a bridging of articles in said vending machine.

19. Vending apparatus as claimed in claim 18 including abutment means in said vending machine adjacent and upper portion of said support wall, said abutment means being adapted to procure a predetermined displacement of articles lying on said support wall, whereby to procure zig-zag stacking of articles within said vending machine.

* * * * *